US005263438A

United States Patent [19]

Cummings

[11] Patent Number: 5,263,438

[45] Date of Patent: Nov. 23, 1993

[54] CATTLE HEAD GATE

[76] Inventor: William D. Cummings, P.O. Box 1635, Garden City, Kans. 67846-1635

[21] Appl. No.: 12,060

[22] Filed: Feb. 1, 1993

[51] Int. Cl.[5] ..... A61D 3/00

[52] U.S. Cl. ..... 119/734; 119/732; 452/54

[58] Field of Search ..... 119/98, 99, 13, 103, 119/147.1; 452/54, 55

[56] References Cited

U.S. PATENT DOCUMENTS 3,135,240 6/1964 Hickman ..... 119/99
3,538,890 11/1970 Torell ..... 119/98
3,929,104 12/1975 Corbin ..... 119/99
4,513,690 4/1985 Waldron ..... 119/99
4,771,737 9/1988 Lynch ..... 119/99

*Primary Examiner*—Gene Mancene
*Assistant Examiner*—Todd E. Manahan
*Attorney, Agent, or Firm*—Edward L. Brown, Jr.

[57] ABSTRACT

A head gate mounted on a cattle squeeze chute through a series of spring-type shock absorbers allows the head gate to move a limited distance in the longitudinal direction from the squeeze chute when impacted by an animal as the pivoting doors on the head gate restrain the animal's forward movement through the chute.

5 Claims, 2 Drawing Sheets

CATTLE HEAD GATE

This invention relates to cattle handling and in particular to a cattle squeeze chute having a head gate structure which is spring mounted thereon to minimize the harm to the cattle.

BACKGROUND OF THE INVENTION

From time to time all types of cattle, be they beef, breeding or dairy types, require treatment with various drugs, medicines, vitamins, ear-tagging, and other treatments. To accomplish this, the cattle are herded into a narrow chute developed to hold the animal while the various treatments can be accomplished. Typically the chutes comprise a pair of movable side walls which prevents the animal from turning around and entrance and exit gates which when closed prevent the animal from moving forward or backward in the chute. The exit gate is generally referred to in the trade as a head gate and it includes a pair of similar gates which move across the chute opening from both sides to a closed position defining a head opening therebetween. Once the cow reaches the proper position in the chute, the pair of head gates are closed around the animal's neck, thus restricting its further movement. By reason of the massive weight of the animal and its excited condition as the head gates close around its neck, frequently there is a substantial impact of the animal with the head gate structure. Due to the substantial weight and strength of cattle, the squeeze chute structure and the head gates are constructed of relatively heavy gauge steel which has relatively no give or deflection. Quite frequently this containment operation results in injury to the animals as they thrash around and impact a very rigid steel structure. Cattle squeeze chutes of this type have been commercially available for many years for use by ranchers or veterinarians.

SUMMARY OF THE INVENTION

While the strength and weight of cattle have required that squeeze chutes and head gates be constructed of relatively heavy gauge steel, there has been no attempt to build in a shock absorbing function on the closing head gate. The present invention includes a head gate structure which is spring mounted to the remaining squeeze chute structure so that when any part of the animal's head or body impacts the head gate, there is a degree of cushion which allows the head gate to move longitudinally forward with increasing resistance to minimize trauma to the animal. This is achieved by providing a separate frame structure which supports and carries the pair of moving head gates. The rectangular head gate frame is attached to the chute structure at its four corners by a compression spring assembly which allows the rigid frame to move a limited distance longitudinally away from the chute structure at any one of or all of its four corners. The squeeze gate structure, both at its top and bottom, provide guide means for the head gate frame, allowing it to move only in a longitudinal direction from the squeeze chute a limited distance, defined by the compression stroke of the separate spring assemblies located at each corner of the head gate frame.

It is therefore the principal object of the present invention to provide an improved cattle head gate structure which will allow the gate to move with increasing resistance upon impact with an animal.

These and other objects and advantages of the head gate of the present invention will become more fully apparent as the description which follows is read in conjunction with the drawings.

DETAILED DESCRIPTION OF A PREFERRED EMBODIMENT

Figure 1:
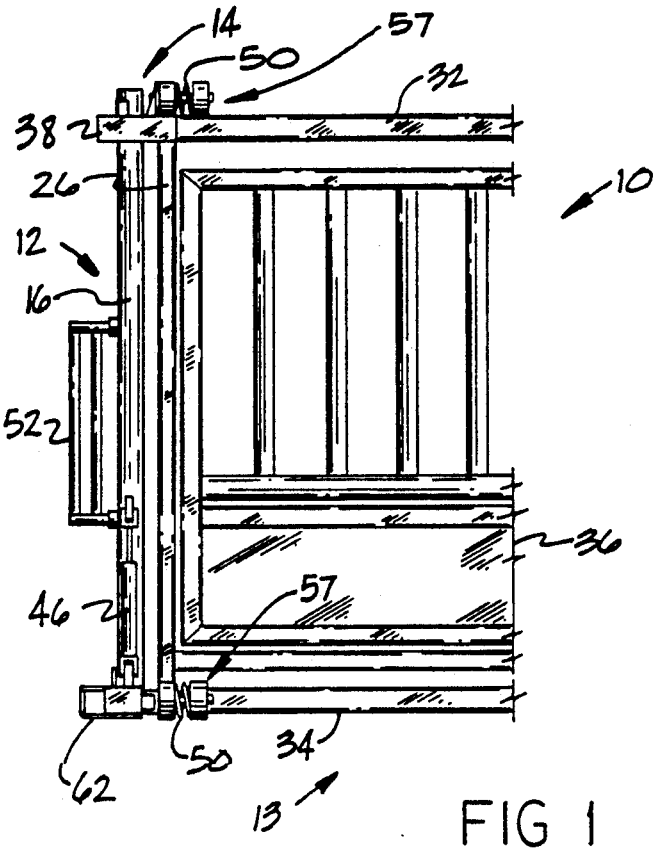
FIG. 1 is a side elevational view of the head gate of the present invention attached to a conventional squeeze gate structure which is only partially shown.
Figure 2:
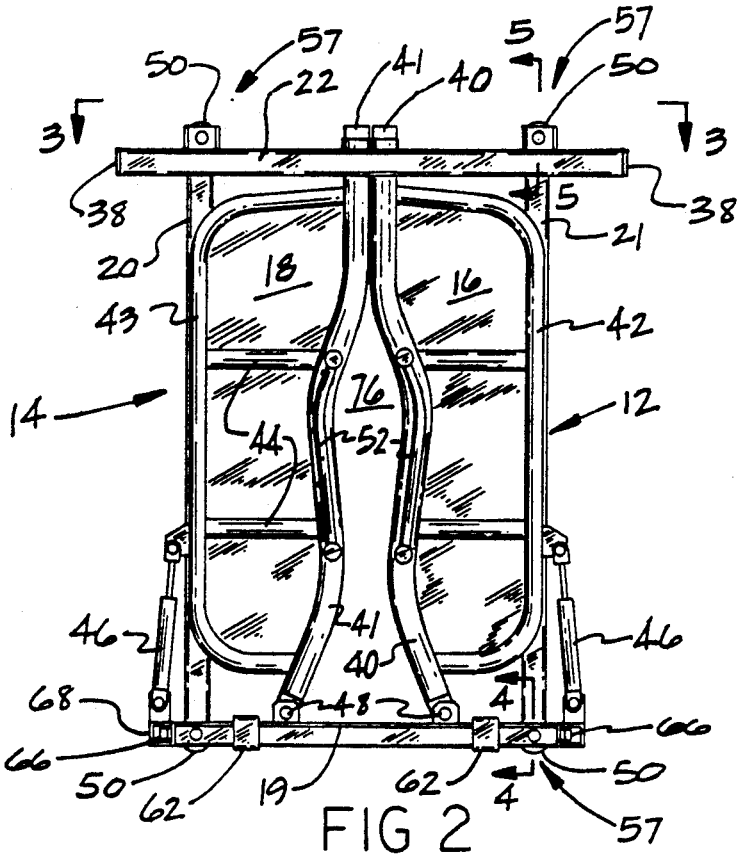
FIG. 2 is a front elevational view of the head gate of the present invention, with the gates in the closed position.
Figure 4:
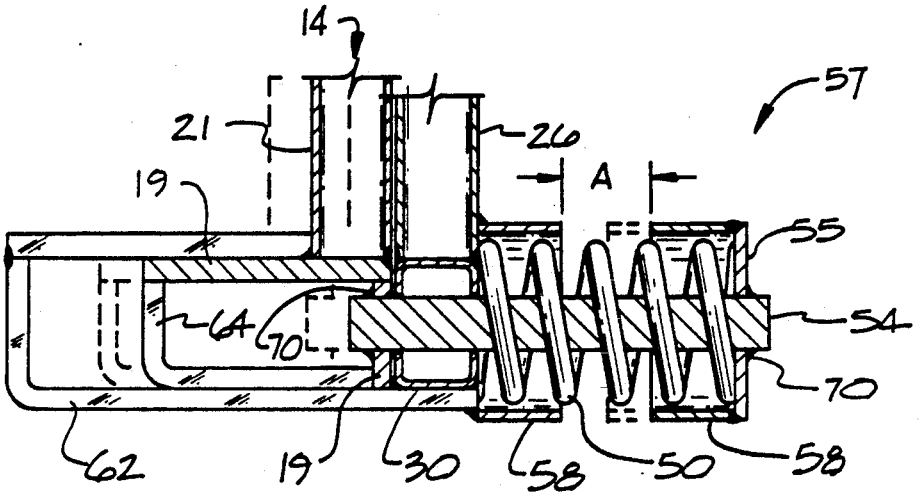
FIG. 4 is a sectional view to an enlarged scale of a lower spring assembly taken along lines 4—4 of FIG. 2.
Figure 5:
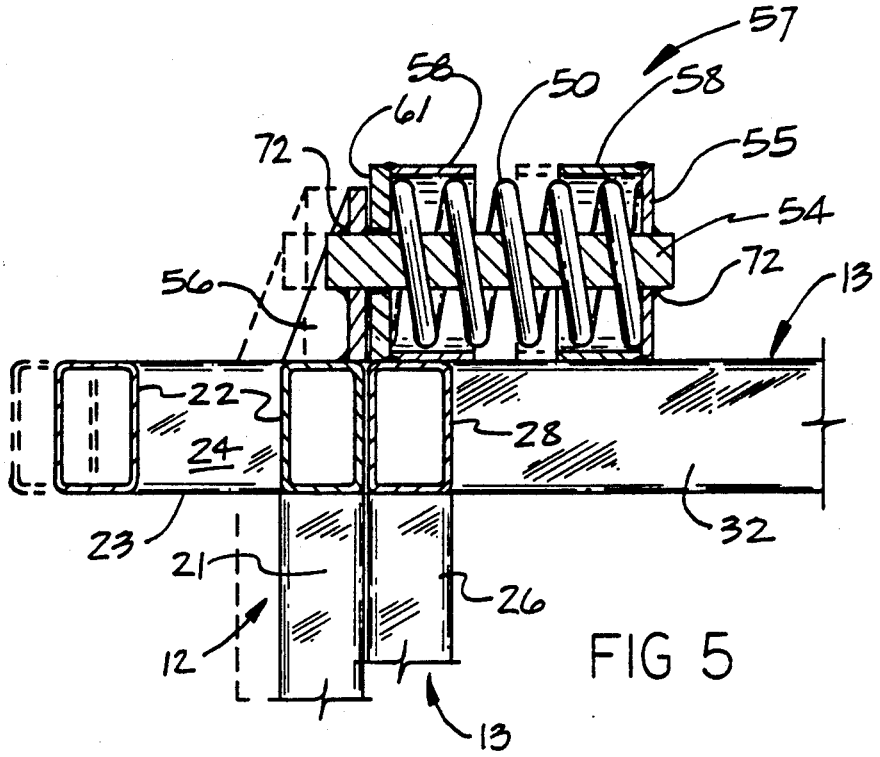
FIG. 5 is a sectional view to an enlarged scale of an upper spring assembly and head gate structure taken along lines 5—5 of FIG. 2.

Turning now to FIGS. 1 and 2, the new and improved livestock head gate is generally recognized by reference 12 and is mounted on the left end of cattle squeeze chute 10, as seen in FIG. 1. Cattle squeeze chutes of this type have been commonly used for decades and are not a part of the present invention and are therefore not shown in detail. Chute 10 comprises a cage-like framework including upper longitudinal members 32, lower longitudinal members 34, and vertical end members 26. Positioned within the chute structure 10 are a pair of movable side walls 36 which can be moved inward when restraining the animal by various different mechanical structures and hydraulic actuators. Typically the side walls 36 are hinged along their bottoms about two closely spaced horizontal axes while a hydraulic actuator moves the top edges of the walls together. Also included in the squeeze chute structure are horizontal top member 28, as seen in FIG. 5, and horizontal bottom member 30, as seen in FIG. 4. All of which are welded together forming a rigid cage.

Figure 3:
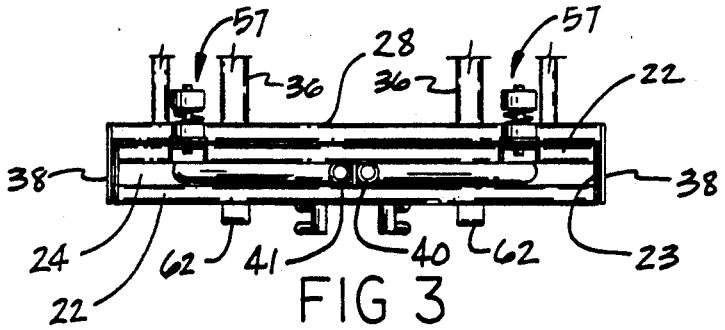
FIG. 3 is a top view of the head gate of the present invention and portions of the adjacent squeeze chute structure partially shown.

The head gate 12 includes a rectangular frame 14, as seen in FIG. 1, having a similar shape as the end of the squeeze chute structure 10. Head gate frame 14 includes two vertical side bars 20 and 21, respectively, as seen in FIG. 2, which are welded to a top horizontal bar 22 and a bottom horizontal bar 19, as seen in FIGS. 5 and 4, respectively. The top horizontal bar 22 includes a second bar 22 spaced in front of the first bar by a strap 23 located on opposite ends of each bar, as seen in FIG. 3. The two spaced apart bars 22 define a slot 24, as shown in FIGS. 3 and 5, for receipt of the inner gate legs 40 and 41.

Gate members 16 and 18 are mirror images of each other, as shown in FIG. 2, and fabricated from sheet and tubular stock including inner legs 40 and 41 and outer legs 42 and 43, respectively. Inner legs 40 and 41 are pivotally mounted to the head gate frame 14 at their lower end through pivot pins 48. Gate members 16 and 18 are each actuated by double acting hydraulic cylinders 46, with each cylinder being pivotally attached to the outside leg of each gate. Cylinders 46 are in turn pivotally anchored on head gate frame bottom member 19, as seen in FIG. 2. In FIGS. 2 and 3, the gates are illustrated in their closed position defining an animal head opening 76 defined therebetween. Located around the head opening 76 on each gate member 16 and 18 are a pair of identical head restraint members 52, as seen in FIGS. 1 and 2. Both gates 16 and 18 include stiffener members 44 between the inside and outside legs of each gate.

Located at all four corners of the head gate frame 14 are spring assemblies 57, as shown in all Figures. Assembly 57 includes a compression spring 50 having a pin 54 positioned in the center thereof with an attached washer 55 which engages spring 50. The left end of pin 54, as seen in FIG. 5, passes through an opening in plate 61 and is welded to a bracket 56 which in turn is welded to the head gate frame 12. Plate 61 is welded to chute 10. Surrounding compression spring 50 are a pair of sleeves 58 which limits the compression of the spring as it compresses a distance A, as seen in FIG. 4. Pin 54 in the lower spring assembly 57, as shown in FIG. 4, extends through a hole in bottom member 30 of the chute structure and is anchored to bar 19 of the head gate frame 12. Surrounding bottom bar 19 is a U-shaped bracket 62 which is welded to the chute member 30 thereby restricting any vertical movement of the head gate frame 14. Bracket 64 slides within bracket 62 and is welded to bottom bar 19 to increase its rigidity.

To limit the lateral horizontal movement of head gate frame 14, guide straps 38, as seen in FIG. 3, are welded to both ends of chute frame member 28, thereby restricting any lateral horizontal movement of head gate frame members 22. as springs 50 compress.

OPERATION

The hydraulically actuated head gates 16 and 18 are moved from a closed position, as seen in FIG. 2, to an open position with the upper ends of legs 40 and 41 resting against strap members 23, as seen in FIG. 3. Uniform movement of gates 16 and 18 can be achieved by various configurations of hydraulic circuits which are well known in the hydraulic art.

As the animal enters the squeeze chute 10, the open head gates 16 and 18 are closed around the animal's neck preventing it from exiting the chute. If the animal attempts to force its way through the head gate, the gate will yield due to the action of the springs 50 located at each corner of the head gate frame 14. The complete head gate 12, including both doors and the frame, will move as a rigid structure in a common plane even though the springs at different corners can deflect varying degrees depending on the load. The head gate 12 can move longitudinally away from the chute structure 10. However, it cannot move laterally and horizontally by reason of the guide members 38, illustrated in FIG. 3. Also, the head gate cannot move in a vertical direction by reason of the brackets 62 which limit the up and down movement of the head gate frame 14. As the pushing or impact load increases, the spring resisting force also increases until the pair of sleeves 58 come in contact with each other at which time no more deflection of the spring is allowed. In designing the particular compression springs 50, they are sized so that at full deflection A, the combined spring forces will exceed the impact energy of the animal. In that manner there will always be a shock absorbing action by one or more of the spring assemblies 57 located at the four corners of the rigid head gate frame 14.

Although a preferred embodiment of the invention has been disclosed, it should be appreciated that variations and modifications may be made thereto without departing from the spirit of the invention.

What I claim as my invention is:

1. An improved head gate on a cattle-squeeze chute, the chute having a longitudinally extending box shaped structure with entry and exit ends on the structure, the head gate being attached to the exit end of the structure; the head gate comprising:

a rigid frame having horizontal top and bottom members;

a pair of doors pivotally mounted to the bottom member of said frame, the top member of the frame including a slot means which receives the upper ends of said doors, guiding their opening and closing movement within the plane of said head gate frame;

actuating means attached to said doors for opening and closing the door around the head of an animal;

biasing means attaching the head gate frame to the squeeze chute structure permitting the head gate frame to move a limited distance in the longitudinal direction from the chute structure whereby the impact and injury of an animal moving longitudinally through the chute with the head gate doors is diminished.

2. An improved head gate as set forth in claim 1, wherein the biasing means comprises a plurality of compression springs positioned between the exit end of the squeeze gate structure and the head gate frame which longitudinally urges the head gate against the exit end of the chute structure and guide means on the chute structure preventing lateral movement of the head gate frame from the chute structure.

3. An improved head gate as set forth in claim 1, wherein the biasing means comprises a plurality of compression springs positioned between the exit end of the squeeze gate structure and the head gate frame which longitudinally urges the head gate against the exit end of the chute structure.

4. An improved head gate as set forth in claim 1, wherein the biasing means comprises four compression coil spring assemblies, one positioned at each corner of the head gate frame and each allowing separate movement of the frame from separate corners of the chute structure.

5. An improved head gate as set forth in claim 1, wherein the biasing means comprises four compression coil spring assemblies, one positioned at each corner of the head gate frame and each allowing separate movement of the frame from separate corners of the chute structure, and each spring assembly including a coil spring, a center shaft anchored to the head gate frame and located within the coiled spring, flange means on the shaft for transferring compression loads to the spring and sleeve means around the spring between the flange means and the frame, limiting the amount of compression of said spring.

* * * * *